US008336115B2

(12) United States Patent
Jordan et al.

(10) Patent No.: US 8,336,115 B2
(45) Date of Patent: Dec. 25, 2012

(54) SURGICAL GOWN WITH ELASTOMERIC FIBROUS SLEEVES

(75) Inventors: Joy Francine Jordan, Marietta, GA (US); Steve Wayne Fitting, Acworth, GA (US); Michael P. Mathis, Marietta, GA (US); Vicky S. Polashock, Roswell, GA (US); John J. Lassig, Dawsonville, GA (US); Renette E. Richard, Atlanta, GA (US); John A. Rotella, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 67 days.

(21) Appl. No.: 12/706,403

(22) Filed: Feb. 16, 2010

(65) Prior Publication Data

US 2010/0138975 A1 Jun. 10, 2010

Related U.S. Application Data

(63) Continuation of application No. 11/156,962, filed on Jun. 20, 2005, now Pat. No. 7,685,649.

(51) Int. Cl.
*A41D 13/12* (2006.01)

(52) U.S. Cl. ..... 2/51; 2/59; 2/125; 2/455; 2/456; 2/457; 2/60; 2/85

(58) Field of Classification Search ..... 2/51, 59, 2/125, 455, 456, 457, 458, 2.11, 2.14, 60, 2/85, 87

See application file for complete search history.

(56) References Cited

U.S. PATENT DOCUMENTS

| | | | |
|---|---|---|---|
| 3,045,815 | A | 7/1962 | Abildgaard |
| 3,338,992 | A | 8/1967 | Kinney |
| 3,341,394 | A | 9/1967 | Kinney |
| 3,502,763 | A | 3/1970 | Hartmann |
| 3,542,615 | A | 11/1970 | Dobo et al. |
| 3,692,618 | A | 9/1972 | Dorschner et al. |
| 3,736,595 | A | 6/1973 | Siegmann |
| 3,802,817 | A | 4/1974 | Matsuki et al. |
| 3,849,241 | A | 11/1974 | Butin et al. |
| 4,041,203 | A | 8/1977 | Brock et al. |
| 4,133,624 | A | 1/1979 | Heavner et al. |
| 4,340,563 | A | 7/1982 | Appel et al. |

(Continued)

FOREIGN PATENT DOCUMENTS

EP 1 170 407 A1 1/2002

(Continued)

OTHER PUBLICATIONS

ASTM Designation: D1894-00, "Standard Test Method for Static and Kinetic Coefficients of Friction of Plastic Film and Sheeting", Oct. 2000, pp. 1-6.

*Primary Examiner* — Alissa Tompkins
(74) *Attorney, Agent, or Firm* — Karl V. Sidor

(57) ABSTRACT

A protective garment, such as a surgical gown, includes a garment body defining sleeves. A cuff may be secured at respective ends of the sleeves. An elastic fiber layer is disposed on the sleeves beginning at the sleeve or cuff. The elastic fiber layer has a high friction surface such that an end of a glove pulled over the elastic fiber layer is inhibited from rolling or sliding back over the elastic fiber and down the sleeve. The elastic fiber may be formed of a polyolefin or other polymers according to known processes and may include a dye or colorant that may be used to indicate the fluid protection level of, for example, a surgical gown.

9 Claims, 3 Drawing Sheets

U.S. PATENT DOCUMENTS

| | | | |
|---|---|---|---|
| 4,389,734 | A | 6/1983 | Franz et al. |
| 4,504,977 | A | 3/1985 | King et al. |
| 4,504,978 | A | 3/1985 | Gregory, Jr. et al. |
| 4,586,196 | A | 5/1986 | White |
| 4,789,699 | A | 12/1988 | Kieffer et al. |
| 4,937,881 | A | 7/1990 | Heise |
| 5,001,785 | A | 3/1991 | Heiman et al. |
| 5,033,115 | A | 7/1991 | Bowling et al. |
| 5,057,368 | A | 10/1991 | Largman et al. |
| 5,069,970 | A | 12/1991 | Largman et al. |
| 5,073,436 | A | 12/1991 | Antonacci et al. |
| 5,145,727 | A | 9/1992 | Potts et al. |
| 5,169,706 | A | 12/1992 | Collier, IV et al. |
| 5,178,931 | A | 1/1993 | Perkins et al. |
| 5,188,885 | A | 2/1993 | Timmons et al. |
| 5,254,391 | A | 10/1993 | Davis |
| 5,272,236 | A | 12/1993 | Lai et al. |
| 5,277,976 | A | 1/1994 | Hogle et al. |
| 5,278,272 | A | 1/1994 | Lai et al. |
| 5,306,545 | A | 4/1994 | Shirayanagi et al. |
| 5,322,728 | A | 6/1994 | Davey et al. |
| 5,414,867 | A | 5/1995 | Bowling et al. |
| 5,444,871 | A | 8/1995 | Lopez |
| 5,466,410 | A | 11/1995 | Hills |
| 5,555,561 | A | 9/1996 | Plachta et al. |
| 5,561,861 | A | 10/1996 | Lopez et al. |
| 5,572,743 | A | 11/1996 | Yavitz |
| 5,588,155 | A | 12/1996 | Baker et al. |
| 5,594,955 | A | 1/1997 | Sommers |
| 5,628,067 | A | 5/1997 | Meyer et al. |
| 5,673,433 | A | 10/1997 | Rothrum |
| 5,680,653 | A | 10/1997 | Mathis et al. |
| 5,693,401 | A | 12/1997 | Sommers et al. |
| 5,724,674 | A | 3/1998 | Covington et al. |
| 5,729,836 | A | 3/1998 | Ewing |
| 5,749,098 | A | 5/1998 | Evans |
| 5,802,609 | A | 9/1998 | Garofalo |
| 5,901,706 | A | 5/1999 | Griesbach et al. |
| 5,924,130 | A | 7/1999 | Fragomeli |
| 5,948,707 | A | 9/1999 | Crawley et al. |
| 6,049,907 | A | 4/2000 | Palomo |
| D431,693 | S | 10/2000 | Urquhart et al. |
| 6,235,659 | B1 | 5/2001 | McAmish et al. |
| 6,286,144 | B1 | 9/2001 | Henderson et al. |
| 6,530,090 | B1 | 3/2003 | Ambrose et al. |
| 6,601,239 | B2 | 8/2003 | Drake |
| 6,665,880 | B2 | 12/2003 | Poppe |
| 6,851,125 | B2 | 2/2005 | Fujikawa et al. |
| 6,934,969 | B2 | 8/2005 | Schorr et al. |
| 6,941,579 | B2 | 9/2005 | Tanenbaum |
| 7,003,804 | B2 | 2/2006 | Lewis |
| 7,052,642 | B2 | 5/2006 | Triebes et al. |
| 7,155,746 | B2 | 1/2007 | Schorr et al. |
| 7,302,711 | B1 | 12/2007 | Tanenbaum |
| 7,685,649 | B2 | 3/2010 | Jordan et al. |
| 2001/0053643 | A1 | 12/2001 | McAmish et al. |
| 2003/0118761 | A1 | 6/2003 | Triebes et al. |
| 2003/0118837 | A1 | 6/2003 | Modha et al. |
| 2003/0226191 | A1 | 12/2003 | Modha et al. |
| 2004/0123367 | A1 | 7/2004 | Schorr et al. |
| 2004/0219337 | A1 | 11/2004 | Langley et al. |
| 2005/0087573 | A1 | 4/2005 | Unsworth et al. |
| 2005/0106982 | A1 | 5/2005 | Berrigan et al. |
| 2005/0223471 | A1 | 10/2005 | Griesbach, III et al. |
| 2005/0241046 | A1 | 11/2005 | Griesbach et al. |
| 2006/0085887 | A1 | 4/2006 | Palomo et al. |
| 2006/0096003 | A1 | 5/2006 | Plaatje et al. |
| 2006/0218694 | A1 | 10/2006 | Mathis et al. |
| 2006/0218697 | A1 | 10/2006 | Modha et al. |
| 2007/0000006 | A1 | 1/2007 | Jordan et al. |
| 2007/0192932 | A1 | 8/2007 | Wells |

FOREIGN PATENT DOCUMENTS

| | | | |
|---|---|---|---|
| EP | 1 649 768 | A1 | 4/2006 |
| GB | 2 237 975 | A | 5/1991 |
| WO | WO 01/34053 | | 5/2001 |
| WO | WO 02/29146 | | 4/2002 |
| WO | WO 02/32661 | | 4/2002 |
| WO | WO 02/083406 | | 10/2002 |
| WO | WO 03/037121 | | 5/2003 |
| WO | WO 03/037612 | | 5/2003 |
| WO | WO 2004/085142 | | 10/2004 |

SURGICAL GOWN WITH ELASTOMERIC FIBROUS SLEEVES

This application is a continuation of U.S. Ser. No. 11/156,962 entitled "Surgical Gown With Elastomeric Fibrous Sleeves" by Joy F. Jordan et al., filed Jun. 20, 2005, now U.S Pat. No. 7,685,649 which is hereby incorporated by reference herein for all purposes.

The present invention relates generally to protective garments for use with gloves, for example surgical gowns used with surgical gloves.

Protective garments, such as coveralls and gowns, designed to provide barrier protection to a wearer are well known in the art. Such protective garments are used in situations where isolation of a wearer from a particular environment is desirable, or it is desirable to inhibit or retard the passage of hazardous liquids and biological contaminates through the garment to the wearer.

In the medical and health-care industry, particularly with surgical procedures, a primary concern is isolation of the medical practitioner from patient fluids such as blood, saliva, perspiration, etc. Protective garments rely on the barrier properties of the fabrics used in the garments, and on the construction and design of the garment. Openings or seams in the garments may be unsatisfactory, especially if the seams or openings are located in positions where they may be subjected to stress and/or direct contact with the hazardous substances.

Gloves are commonly worn in conjunction with protective garments, particularly in the medical industry. Typically, the gloves are pulled up over the cuff and sleeve of a gown or garment. However, the interface between the glove and the protective garment can be an area of concern. For example, a common issue with surgical gloves is glove "roll-down" or slippage resulting from a low frictional interface between the interior side of the glove and the surgical gown sleeve. When the glove rolls down or slips on the sleeve, the wearer is at greater risk of exposure to patient fluids and/or other contaminants.

An additional problem associated with the use of surgical gloves is that as a result of the gloves being pulled up over the cuff and sleeve of the gown, a phenomenon known as "channeling" occurs. That is, the sleeve of the gown is bunched up under the glove as a result of pulling and rolling the glove up over the cuff and sleeve. Channels may develop along the wearer's wrist which may become accessible to patient fluids running down the outside of the sleeve of the gown. Such fluids may enter the channels and work down along the channels between the outer surface of the gown and inner surface of the surgical glove. The fluids may then contaminate the gown cuff, which lies directly against the wearer's wrist or forearm, particularly if the cuff is absorbent or fluid pervious.

Surgeons and other medical personnel have attempted to address concerns with the glove and gown interface in different ways. For example, it has been a common practice to use adhesive tape wrapped around the glove portion extending over the gown sleeve to prevent channels and roll down of the glove on the sleeve. This approach unfortunately has some drawbacks. Many of the common adhesives utilized in tapes are subject to attack by water and body fluids and the seal can be broken during a procedure. Another approach has been to stretch a rubber band around the glove and sleeve. This practice is, however, awkward to implement and difficult to adjust or to vary the pressure exerted by the rubber band other than by using rubber bands of different sizes and tensions, which of course necessitates having a variety of rubber bands available for use. Yet another approach has been to incorporate a band of elastomeric polymer on the gown around the sleeve just above the cuff to provide a surface for the glove to cling to. This approach has also proved less than completely satisfactory.

A need exists for an improved device and method for providing an effective sealing interface between a glove and sleeve of a protective garment, wherein the device is easily incorporated with the protective garment and economically cost effective to implement. A further need exists for a gown sleeve that provides a more effective barrier to fluid while retaining a glove.

SUMMARY

The present invention provides a protective garment incorporating an effective and economical means for improving the interface area between the sleeves of the garment and a glove pulled over the sleeves. The improvement inhibits the proximal end of the glove from rolling or sliding back down the garment sleeves once the wearer has pulled the gloves on. In this way, the garment according to the invention addresses at least certain of the disadvantages of conventional garments discussed above.

It should be appreciated that, although the present invention has particular usefulness as a surgical gown, the invention is not limited in scope to surgical gowns or the medical industry.

The protective garment according to the present invention has wide application and can be used in any instance wherein a protective coverall, gown, robe, etc., is used with gloves. All such uses and garments are contemplated within the scope of the invention.

In an embodiment of the invention, a protective garment is provided having a garment body. The garment may be, for example, a surgical gown, a protective coverall, etc. The garment body includes sleeves, and the sleeves may have a cuff disposed at the distal end thereof. The cuffs may be formed from or include elastic fibers, and may be liquid retentive or liquid impervious.

In one embodiment, the sleeve is formed with a layer of spunbond elastomeric fibers on the outside, where it may be contacted by a glove. The entire sleeve may advantageously be made of the elastomeric fiber or it may be a component of the outer layer along with non-elastomeric fibers. The elastomeric fibers are by their nature more tacky than non-elastomeric fibers and so provide a higher surface friction between the glove and garment to help keep the glove in place.

The elastomeric fibers prevent glove roll-down while not causing the sleeves to adhere to the gown body when the gown is folded.

Embodiments of the protective garment according to the invention are described below in greater detail with reference to the appended figures.

DETAILED DESCRIPTION

Figure 1:
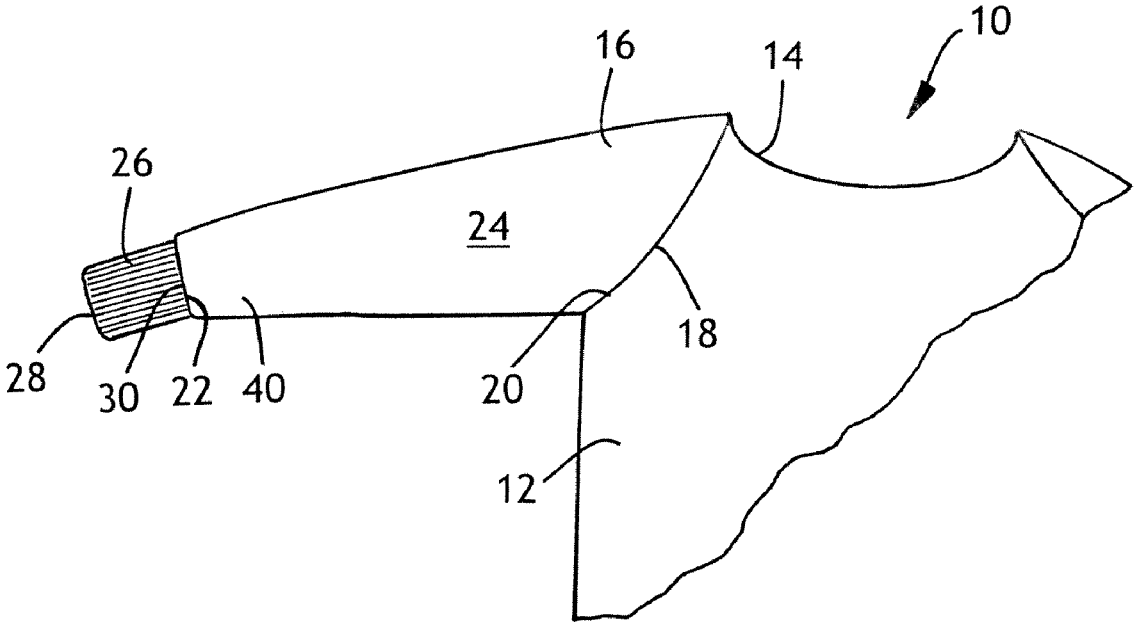
FIG. 1 is a partial side view of an embodiment of a protective garment according to the present invention.

Reference will now be made in detail to one or more examples of the invention depicted in the figures. Each example is provided by way of explanation of the invention, and not meant as a limitation of the invention. For example, features illustrated or described as part of one embodiment may be used with another embodiment to yield still a different embodiment. Other modifications and variations to the described embodiments are also contemplated within the scope and spirit of the invention.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns. The fibers may also have shapes such as those described in U.S. Pat. No. 5,277,976 to Hogle et al., U.S. Pat. No. 5,466,410 to Hills and U.S. Pat. Nos. 5,069,970 and 5,057,368 to Largman et al., which describe fibers with unconventional shapes.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

As used herein "multilayer nonwoven laminate" means a laminate wherein some of the layers are spunbond and some meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy. Multilayer laminates may also have various numbers of meltblown layers or multiple spunbond layers in many different configurations and may include other materials like films (F) or coform materials, e.g. SMMS, SM, SFS, etc.

FIG. 1 illustrates a protective garment 10 according to the invention. The garment 10 includes a main body portion 12, a neck portion 14, and sleeves 16 (one sleeve shown). The sleeves 16 may be made separately and attached at to the main body portion 12 at a seam 18 or formed as an integral component with the main body portion 12. Each sleeve 16 may include an upper or proximal end 20, a lower of distal end 22, and an exterior surface 24.

The garment 10 is depicted as a surgical gown for illustrative purposes only. The garment 10 may be any type or style of protective covering that is generally worn about the body and includes sleeves.

The terms "lower" or "distal" are used herein to denote features that are closer to the hands of the wearer. The terms "upper" or "proximal" are used to denote features that are closer to the shoulder of the wearer.

It should be appreciated that the type of fabric or material used for garment 10 is not a limiting factor of the invention. The garment 10 may be made from a multitude of materials, including multilayer nonwoven laminates suitable for disposable use. For example, gown embodiments of the garment 10 may be made of a stretchable nonwoven material so that the gown is less likely to tear during donning or wearing of the gown.

A material particularly well suited for use with the present invention is a three-layer nonwoven polypropylene material known as SMS. "SMS" is an acronym for Spunbond, Meltblown, Spunbond, the process by which the three layers are constructed and then laminated together. One particular advantage is that the SMS material exhibits enhanced fluid barrier characteristics. It should be noted, however, that other multilayer nonwoven laminates as well as other materials including wovens, elastic fibers, foam/elastic fiber laminates, and combinations thereof may be used to construct the garment of the present invention, provided a layer containing elastomeric spunbond fibers is provided as the outermost surface. Examples include SMS laminates where one of the outer layers is spunbond elastic fiber.

The sleeves 16 may incorporate a cuff 26 attached to the distal end 22 thereof. The cuff 26 also has a distal end 28 and a proximal end 30. The configuration and materials used in the cuff 26 may vary widely. For example, short, tight-fitting cuffs made from a knitted material may be provided. The cuff 26 may be formed with or without ribs. The cuff may be formed of a liquid repellant material or a liquid retentive material. Cuffs suitable for use with garments according to the present invention are described in U.S. Pat. Nos. 5,594,955 and 5,680,653, both of which are incorporated herein in their entirety for all purposes.

Figure 2:
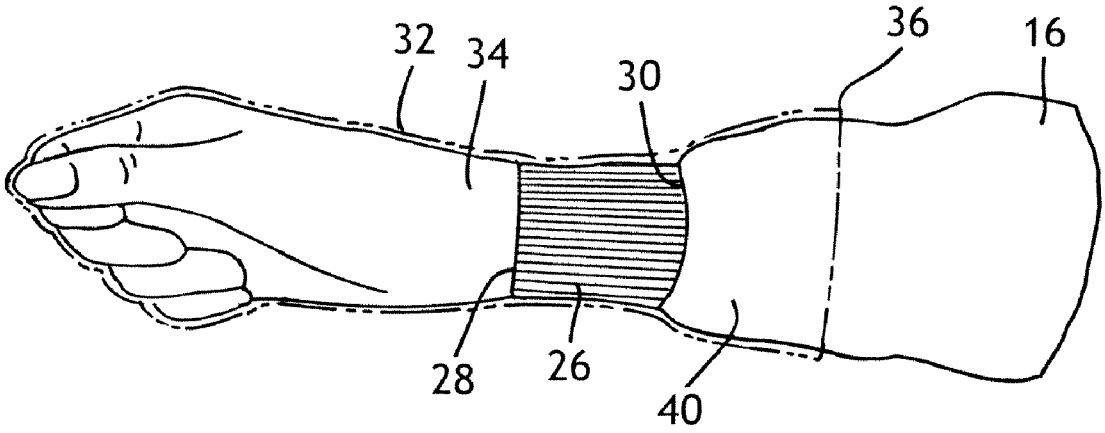
FIG. 2 is a partial side view of a garment sleeve according to an embodiment of the present invention.

As shown for example in FIG. 2, protective garments are frequently used with gloves, such as a surgical glove 32 that is pulled over the hand of the wearer and has a sufficient length so that a proximal portion of the glove 32 overlaps the cuff 26 and a portion of the sleeve 16. An interface is thus established between the glove interior surface and the exterior surface 24 of the sleeve 16 and cuff 26. This interface region preferably inhibits undesirable fluids or other contaminants from running down the sleeve 16 to the cuff 26 or hand 34 of the wearer. However, glove slippage or roll-down occurs if the frictional interface between the glove interior surface and the sleeve exterior surface is insufficient to maintain the glove in position above the cuff 26. When glove roll-down occurs, the wearer is at greater risk of exposure to contaminants, particularly during a surgical procedure.

Many types of protective gloves, particularly elastic synthetic or natural rubber surgical gloves, have a thickened bead or region at the open proximal end 36. This thickened portion or bead is intended to strengthen the glove 32 and provide an area of increased elastic tension to aid in holding the glove 32 up on the sleeve 16.

According to one embodiment of the invention, the garment 10 includes an elastic fiber layer 40 formed on the outside of the sleeves 16 from the proximal end 30 of the cuff 26 (FIGS. 1 and 2). The elastic fiber layer 40 thus acts as a high friction surface against which the thickened proximal end 36 of the glove 32 contacts if the glove tends to slip down the exterior surface 24 of the glove. The elastic fiber layer 40 inhibits further slippage or roll-down of the glove 32. The terms "elastic" and "elastomeric" in reference to fibers means a fiber or fibrous web which, when stretched up to 100 percent of its unstretched length, will, once the stretching force is removed, recover to at most 150 percent of its unstretched length. If, for example, an elastic fibrous web is stretched from 10 centimeters in length to 20 centimeters in length and the stretching force released, it will recover to a length of at most 15 centimeters.

Figure 3:
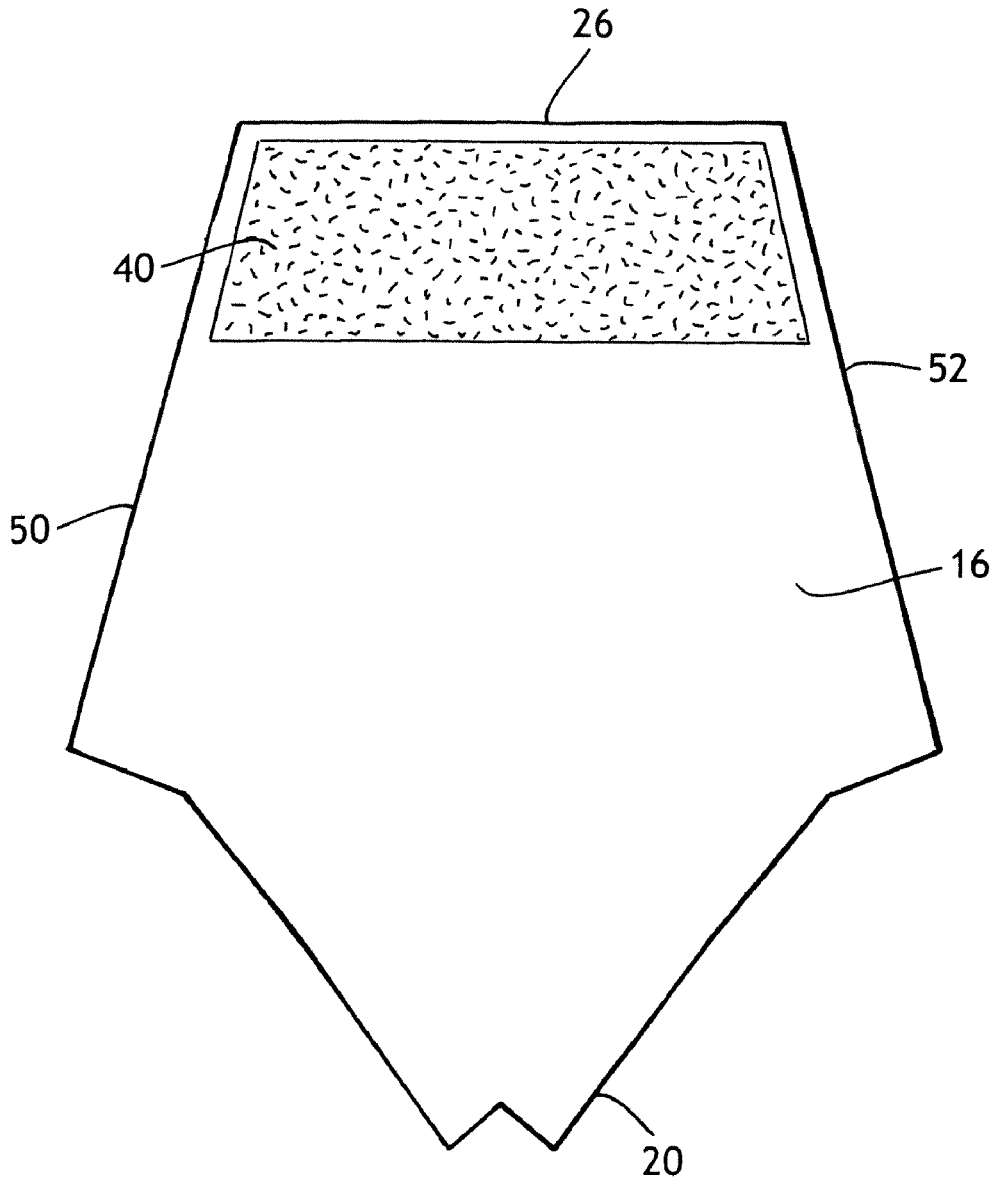
FIG. 3 is an illustration of an exemplary flat sleeve piece before it is formed into a separate sleeve.

The elastic fiber layer 40 may extend up the sleeve 16 a distance greater than the proximal end 36 of the glove 32 extends when the glove is normally donned. The dimensions of the elastic fiber area may vary as the size of the gown may also vary. As shown in FIG. 3, the elastic fiber area may extend away from the cuff 26 for a distance of about 20 inches (51 cm), more particularly about 10 inches (25 cm).

It should be appreciated that the elastic fiber layer 40 can take on many different configurations. FIG. 3 shows a flat sleeve piece before it is formed into a separate sleeve 16. The sleeve 16 may be formed by bonding, for example ultrasonically, the two edges 50, 52 to each other and thereafter bonding the sleeve 16 to the main body portion 12 at the sleeve's distal end 20 to form a seam 18. The elastic fiber layer 40 may be continuous around the sleeve 16. The particular geometric configuration of the elastic fiber layer 40 may vary widely so long as a generally circumferentially extending area or region is provided, with the elastic fiber being sufficient to inhibit glove slippage or roll-down.

The inventors have surprisingly found that a relatively uniform elastic fiber layer of a low-tack, high-friction polymer is quite effective and lends itself easily to modern manufacturing techniques. The elastic fiber layer 40 may be formed on the sleeve in various known ways and from a variety of materials. It is contemplated that the most cost-effective and rapid is the direct formation of the elastic layer onto the meltblown layer in, for example, as the spunbond layer of an SMS laminate.

The elastic fiber layer 40 may be formed of an inherently low-tack material with high frictional characteristics. This type of elastic fiber increases slip resistance between the glove and sleeve 16 and may be applied directly onto the exterior surface 24 of the sleeve to form the elastic fiber layer 40. In general, the elastic fiber could be any polymer that is sufficiently soft and pliable so as to cling to the inside surface of the glove 32 but at the same time should not have too high a tack level so as to cause the garment sleeve 16 to stick to the garment body 12 when the garment 10 is folded, hence the term "low-tack". The term "high frictional characteristics" means that the coefficient of friction of the fabric having the elastic fiber is higher than the same fabric without an elastic fiber.

Polymers such as metallocene based polyolefins are suitable examples of acceptable elastic fiber formers. Such polymers are available from ExxonMobil Chemical under the trade names ACHIEVE® and Vistamaxx™ for polypropylene based polymers and EXACT® and EXCEED® for polyethylene based polymers. Dow Chemical Company of Midland, Mich. has polymers commercially available under the names ENGAGE® and VERSIFY®. These materials are believed to be produced using non-stereo selective metallocene catalysts. ExxonMobil generally refers to their metallocene catalyst technology as "single site" catalysts while Dow refers to theirs as "constrained geometry" catalysts under the name INSIGHT® to distinguish them from traditional Ziegler-Natta catalysts which have multiple reaction sites.

Vistamaxx™ polymers are advertised as having a melt flow rate of 0.5 to 35 g/10 min., a glass transition temperature of from −20 to −30° C. and a melting temperature of from 40-160° C. Two new Vistamaxx™ grades, VM-2120 and 2125 have recently become available and these grades have a melt flow rate of about 80 with the VM-2125 grade having greater elasticity. Commercial ACHIEVE® grades include 6936G1 and 3854.

Dow's VERSIFY® polymers have a melt flow rate from 2 to 25 g/10 min., a glass transition temperature of from −15 to −35° C. and a melting temperature of from 50 -135° C.

U.S. Pat. No. 5,204,429 to Kaminsky et al. describes a process which may produce elastic copolymers from cycloolefins and linear olefins using a catalyst which is a sterorigid chiral metallocene transition metal compound and an aluminoxane. The polymerization is carried out in an inert solvent such as an aliphatic or cycloaliphatic hydrocarbon such as toluene. The reaction may also occur in the gas phase using the monomers to be polymerized as the solvent. U.S. Pat. Nos. 5,278,272 and 5,272,236, both to Lai et al., assigned to Dow Chemical and entitled "Elastic Substantially Linear Olefin Polymers" describe polymers having particular elastic properties.

Other suitable elastic fibers include, for example, ethylene vinyl acetate copolymers, styrene-butadiene, cellulose acetate butyrate, ethyl cellulose, synthetic rubbers including, for example, Kraton® block copolymers, natural rubber, polyurethanes, polyethylenes, polyamides, flexible polyolefins, and amorphous polyalphaolefins (APAO).

In the practice of the instant invention, elastic polyolefins like polypropylene and polyethylene are desirable, most desirably elastic polypropylene. Elastic fiber may be from 100 percent of the layer to as little as 10 percent, more particularly between 50 and 100 percent. The basis weight of the fabric may be between 0.1 and 10 osy (0.34 and 34 gsm), desirably between 0.5 and 5 osy (0.6 and 15.8 gsm) more desirably between 0.5 and 1.5 osy (0.6 and 51 gsm).

Other materials may be added to the elastic fiber to provide particular characteristics. These optional materials may include, for example, dyes, pigment or other colorants to give the elastic fiber area a visually perceptible color such as yellow, green, red or blue (e.g. Sudan Blue 670 from BASF). These colors may be used to indicate the protection level accorded by the gown according to, for example, the standards of the Association for the Advancement of Medical Instrumentation (AAMI), e.g., ANSI/AAMI PB70:2003. A user would thus be able to select a gown for a surgical procedure where the sleeve color corresponded to or indicated the fluid protection level of the gown.

Fabrics were produced by the spunbond process in order to test the invention. These fabrics were then tested for the coefficient of friction (COF) according to ASTM test method D1894. A control sleeve fabric made from ExxonMobil's PP3155 homopolymer polypropylene (36 g/10 min. melt flow) had a COF of 0.414 in the machine direction (MD) and of 0.538 in the cross machine direction (CD). An inventive fabric made from ExxonMobil's Vistamaxx™ polypropylene had a COF of 0.868 in the MD and of 0.1.332 in the CD. An inventive fabric made from Dow's VERSIFY® polypropylene had a COF of 0.858 in the MD and of 0.1.042 in the CD. The inventive sleeve fabric, therefore, had a COF in either the machine or cross-machine directions that was at least twice that of a traditional spunbonding polypropylene like ExxonMobil's PP3155. Fibers that produce fabrics with such high frictional characteristics will result in less glove slip-down and better protection for the wearer. In addition, these fabrics were not so tacky as to cause "blocking" or the inability to separate them, after they were folded over onto themselves.

It should be appreciated by those skilled in the art that various modifications and variations can be made to the embodiments of the present invention described and illustrated herein without departing from the scope and spirit of the invention. The invention includes such modifications and variations coming within the meaning and range of equivalency of the appended claims.

What is claimed is:

1. A protective garment, comprising:

a garment body;

a first sleeve and a second sleeve extending from the garment body, each sleeve having a proximal end at the garment body and each sleeve having a distal end in which the material forming the distal end of the sleeve is a multilayer nonwoven fabric of non-elastomeric fibers;

a layer of elastic fibers providing the outermost surface of the multilayer nonwoven fabric at the distal end of each of the sleeves; and a cuff secured at respective ends of said sleeves;

wherein the layer of elastic fibers provides a coefficient of friction that is at least twice that of the multilayer nonwoven fabric of non-elastomeric fibers such that the layer of elastic fibers provides a high friction surface such that an end of a glove pulled over the layer of elastic fibers is inhibited from rolling or sliding back.

2. The protective garment as in claim 1, wherein the layer of elastic fibers provides a coefficient of friction that is at least twice that of the multilayer nonwoven fabric consisting essentially of non-elastomeric fibers in both the machine direction and the cross-machine directions.

3. The protective garment as in claim 1, wherein the layer of elastic fibers further includes a dye or colorant.

4. The protective garment as in claim 1, wherein said garment body is a surgical gown.

5. The protective garment as in claim 1, wherein the non-elastomeric fibers are made of homopolymer polypropylene.

6. A protective garment, comprising:

a garment body;

a first sleeve and a second sleeve extending from the garment body, each sleeve having a proximal end at the garment body and each sleeve having a distal end in which the material forming the distal end of the sleeve is a multilayer nonwoven fabric including:

a layer of meltblown fabric formed of non-elastomeric fibers, and a layer of spunbond fabric forming an outermost layer of the multilayer nonwoven fabric, the layer of spunbond fabric comprising:

a layer of spunbond fabric formed of non-elastomeric fibers, the spunbond fabric being adjacent the meltblown fabric; and a layer of elastic fibers, the elastic fibers providing an outermost surface of the multilayer nonwoven fabric; and a cuff secured at respective ends of said sleeves;

wherein the layer of spunbond fabric provides a high friction surface such that an end of a glove pulled over the layer of spunbond fabric is inhibited from rolling or sliding back.

7. The protective garment as in claim 6, wherein the layer of spunbond fabric further includes a dye or colorant.

8. The protective garment as in claim 6, wherein said garment body is a surgical gown.

9. The protective garment as in claim 6, wherein the non-elastomeric fibers are made of homopolymer polypropylene.

* * * * *